US005533472A

United States Patent [19]

Sands et al.

[11] Patent Number: 5,533,472

[45] Date of Patent: Jul. 9, 1996

[54] OIL JET NOZZLE FOR AN INTERNAL COMBUSTION WITH RECIPROCATING PISTONS

[75] Inventors: Richard H. Sands, Ontario, Canada; Jerry P. Harkey, Bloomfield Hills; J. Gary Pace, Rochester, both of Mich.

[73] Assignee: Chrysler Corporation, Auburn Hills, Mich.

[21] Appl. No.: 509,379

[22] Filed: Jul. 31, 1995

[51] Int. Cl.[6] ..... F01P 1/04

[52] U.S. Cl. ..... 123/41.35

[58] Field of Search ..... 123/41.35

[56] References Cited

U.S. PATENT DOCUMENTS

| | | | |
|---|---|---|---|
| 2,788,773 | 4/1957 | Meurer | 123/41.35 |
| 2,800,119 | 7/1957 | Schmidl | 123/41.35 |
| 3,709,109 | 1/1973 | Howe | 92/186 |
| 4,010,718 | 3/1977 | Stewart | 123/41.35 |
| 4,204,487 | 5/1980 | Jones | 123/41.35 |
| 4,206,726 | 6/1980 | Johnson, Jr. et al. | 123/41.35 |
| 4,508,065 | 4/1985 | Suchdev | 123/41.35 |
| 4,542,719 | 9/1985 | Wilkinson | 123/41.35 |
| 4,715,335 | 12/1987 | Elsbett et al. | 123/41.35 |
| 4,742,803 | 5/1988 | Chiles et al. | 123/196 M |
| 4,862,838 | 9/1989 | Hodgkins et al. | 123/41.35 |
| 4,869,211 | 9/1989 | Heberle et al. | 123/41.35 |
| 4,995,346 | 2/1991 | Hudson, Jr. | 123/41.35 |
| 5,267,534 | 12/1993 | Berlinger | 123/41.35 |

*Primary Examiner*—Noah P. Kamen
*Attorney, Agent, or Firm*—Kenneth H. MacLean

[57] ABSTRACT

An oil jet nozzle (24) has an extruded body (48) with an integrally formed tab (64). The tab is constructed to be snugly received in an oil groove (32) situated along the bearing seat (34) in the crankshaft journal of the engine block. The groove which receives oil from an oil gallery (42) passes some of the oil through to the nozzle which sprays the oil from two outlets (46) to two adjacent pistons (14) for cooling thereof.

9 Claims, 4 Drawing Sheets

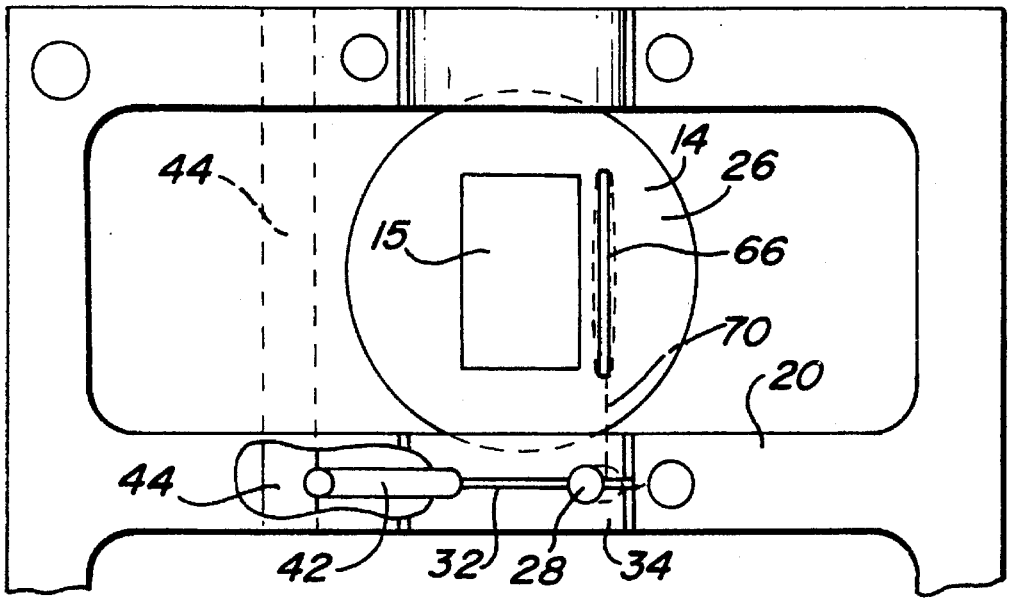
Fig-6
Fig-7
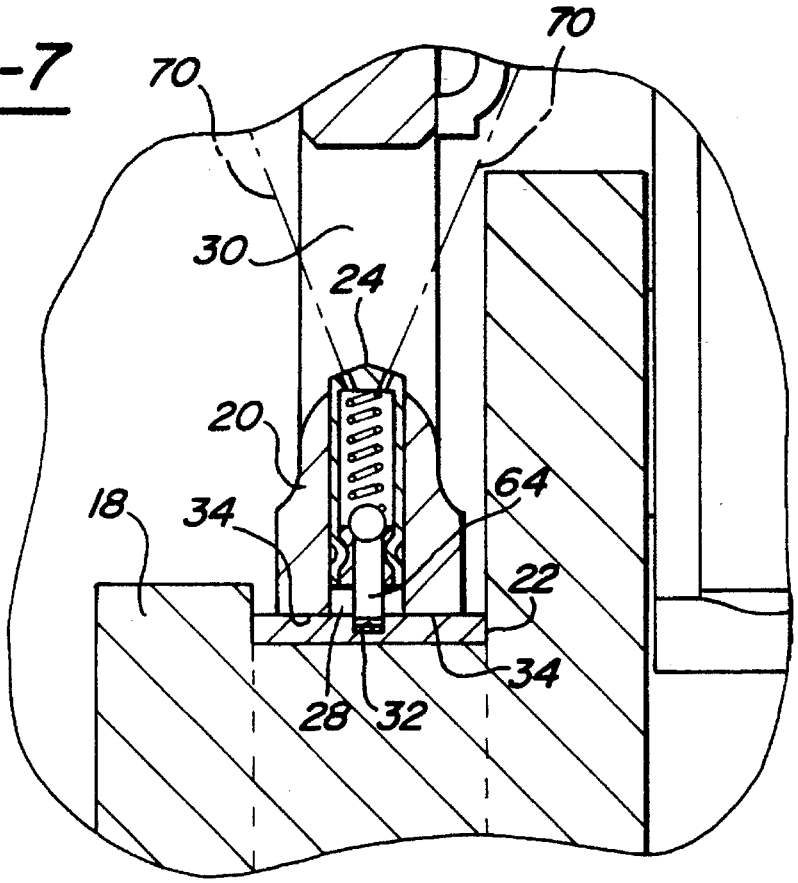

OIL JET NOZZLE FOR AN INTERNAL COMBUSTION WITH RECIPROCATING PISTONS

TECHNICAL FIELD.

The field of this invention relates to an oil jet piston cooling system for spraying oil against the underside of a piston of an internal combustion engine.

BACKGROUND OF THE DISCLOSURE

Oil jet nozzles have long been used to cool the under side of a piston in a reciprocating piston engine. These nozzles are often mounted into a bore that leads to an oil gallery. The nozzle also incorporates a check valve to prevent siphoning off of needed oil pressure during low oil pressure conditions.

However, several problems are evident with known oil jet piston cooling systems. Firstly, threaded nozzles tend to eventually twist about in its bore to misalign the nozzle from the intended area at the underside of the piston.

Secondly, the jet nozzle effectively sprays only one-half of the piston underside. The piston rod blocks the spray path to the other side of the piston from where the nozzle is located. It is now common to have asymmetrical engine combustion and consequently the piston heats unevenly with one side ending up hotter than another side. This asymmetry can be caused by chambers that are asymmetrically contoured and precombustion chambers that may have entrances leading into the main combustion chamber at side locations.

The oil spray thus is desirably directed toward the hotter side. No problems exist when the oil gallery is also positioned on the hot side because the jet nozzle may be merely tapped into the oil gallery and pointed directly upwardly to the hot side with no obstruction therebetween. However, in engines designed with the hotter side on an opposite side relative to the oil gallery, problems arise as to how to provide a nozzle that can both have access to the oil supply while simultaneously directing oil spray without intervening obstructions to the hot side of the piston. The previous solution to this problem has been to drill or cast a second oil gallery at the hot side of the engine block at relatively great expense. Other solutions illustrate convoluted tubing that extends from the oil gallery.

What is needed is an expeditiously constructed cooling oil jet nozzle that remains aligned to spray oil at the intended piston area. What is further needed is an oil jet piston cooling system that is expeditiously fashioned to cool the hot side of a piston with an oil jet nozzle when the oil galley is on the other side from the hot side.

SUMMARY OF THE DISCLOSURE

In accordance with one aspect of the invention, an internal combustion engine has an engine block housing, a reciprocating piston within a piston cylinder and a piston rod operably connecting the piston to a crankshaft. The engine block has a crankshaft cavity under the piston and a crankshaft journal for seating a crankshaft bearing and an oil gallery on one side of the piston cylinder. The oil gallery is operably connected through a path to a groove in one of the crankshaft journal and crankshaft bearing for providing passage through the bearing to the crankshaft. A passage extends from the oil groove to the crankshaft cavity and fitted with a cooling oil jet nozzle for spraying oil onto an underside of the piston preferably at a side opposite from that of the oil gallery.

Desirably, the cooling oil jet piston nozzle has a body member for being press fitted into the passage extending from the oil groove to the crankshaft cavity. The nozzle has a downstream section with outlets and an upstream end with an inlet therethrough. A locating tab is located at an upstream end of the body for seating in the oil groove. The tab has a width such that it is snugly received in the oil groove to rotationally affix the body member in the passage.

Preferably, a check valve is operably seated in the oil jet nozzle and biased to a closed position. The check valve is constructed to be openable upon an oil pressure at the inlet above a predetermined level to allow passage of oil from the inlet through to and out of the outlets.

In one embodiment, the body of the oil jet nozzle is extruded and the tab is integrally formed with the body. The extruded body also has a crimp section that crimps against and retains an inlet and check valve seat member. The seat member has the inlet therethrough with a seat about the inlet for seating a ball check valve.

It is preferable that the passage is interposed between two adjacent piston cylinders within the crankshaft cavity. The outlet end of the oil jet nozzle has two angled outlet ports that are aimed at an adjacent two pistons in the adjacent cylinders of the internal combustion engine. Two jet nozzles thus is all that is needed for a common four cylinder engine.

In accordance with another aspect of the invention, an oil jet piston cooling nozzle is constructed for directing a stream of oil upwardly towards the underside of a reciprocating piston of an internal combustion engine. The nozzle has a body member with a rotationally locking tab located at an upstream end thereof.

In this fashion, an expeditiously manufactured oil jet nozzle can be incorporated in a multi-cylinder reciprocating piston engine that has the capability of maintaining alignment and be easily installed to cool the hot side of a piston even if the oil gallery of the engine block is on an opposing side of the engine block from the hot side.

BRIEF DESCRIPTION OF THE DRAWINGS

Reference now is made to the accompanying drawings in which:

FIG. 6 is a schematic bottom plan view illustrating the position of the spray from oil jet nozzle relative to the piston, piston arm and oil galley; and FIG. 7 is a view similar to FIG. 3 illustrating a modified embodiment.

DETAILED DESCRIPTION OF THE PREFERRED EMBODIMENTS

Figure 1:
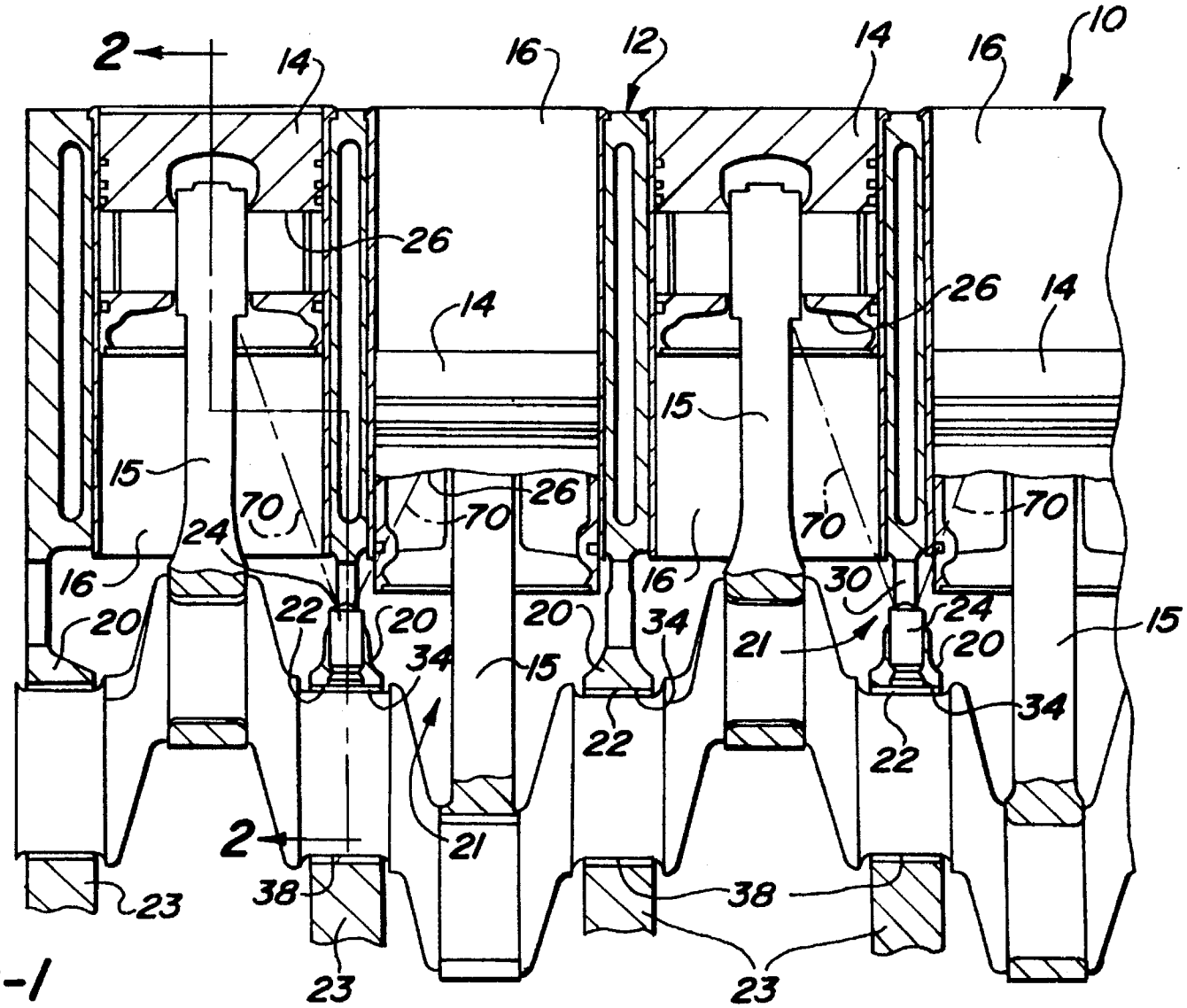
FIG. 1 is a schematic segmented and side elevational view of an engine illustrating one embodiment of the invention.

Referring now to FIG. 1, an internal combustion engine 10 has its engine block 12 housing four pistons 14 in appropriately sized cylinders 16. The pistons are operably connected to a crankshaft 18 via piston rods 15. The lower part of the engine block has a crankshaft cavity 21 that houses the crankshaft 18. The block 12 has journal sections 20 that help mount the crankshaft 18 in position with a conventional lower crankshaft housing 23 and with bearing sleeves 22. An oil jet nozzle 24 is mounted through the journal sections 20 to spray oil onto the piston undersides 26. A total of two nozzles 24 is all that is needed for a four cylinder engine. Because each nozzle 24 is identical, reference is now only made to one nozzle 24 unless otherwise indicated.

Figure 2:
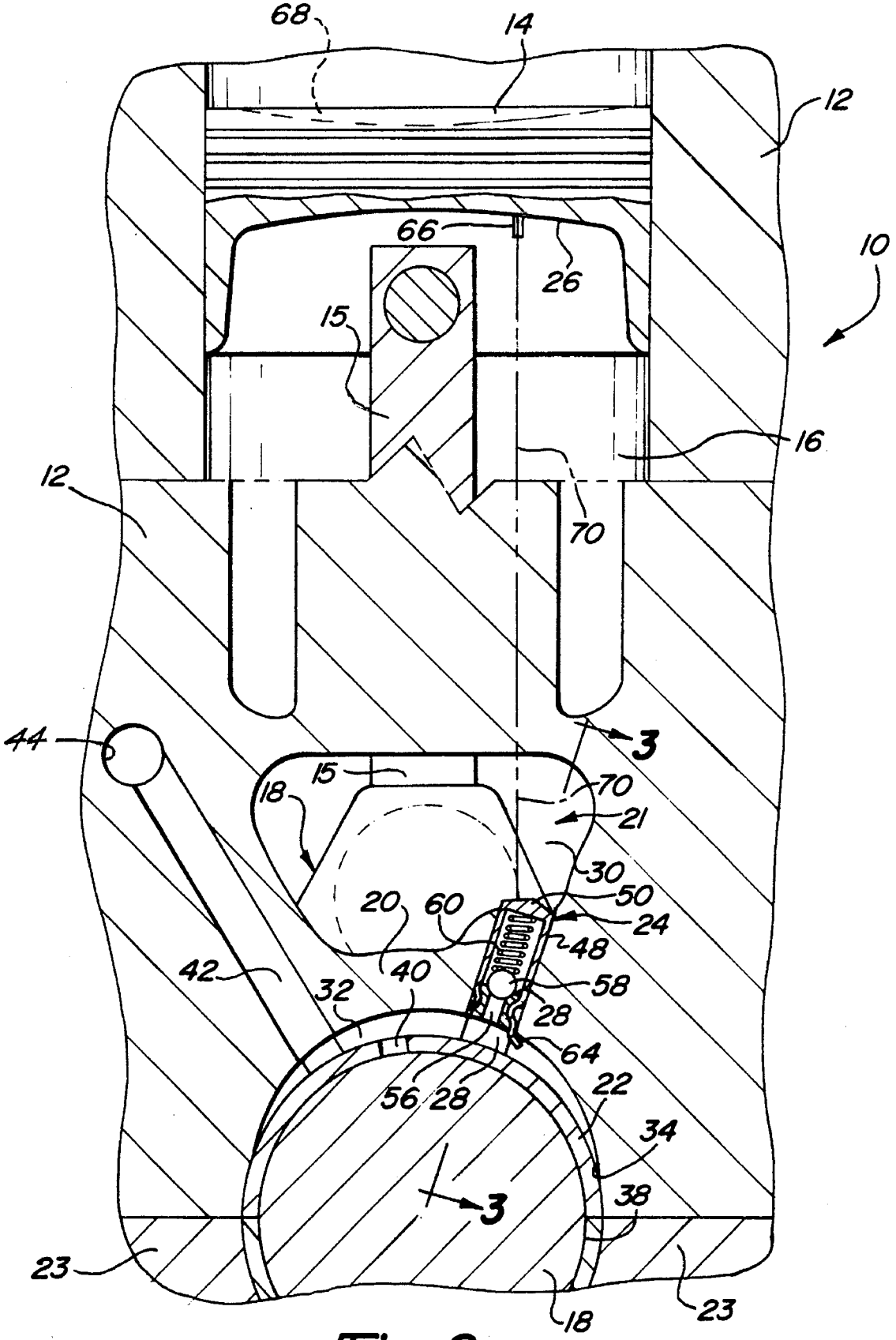
FIG. 2 is cross sectional view taken along lines 2—2 shown in FIG. 1.
Figure 3:
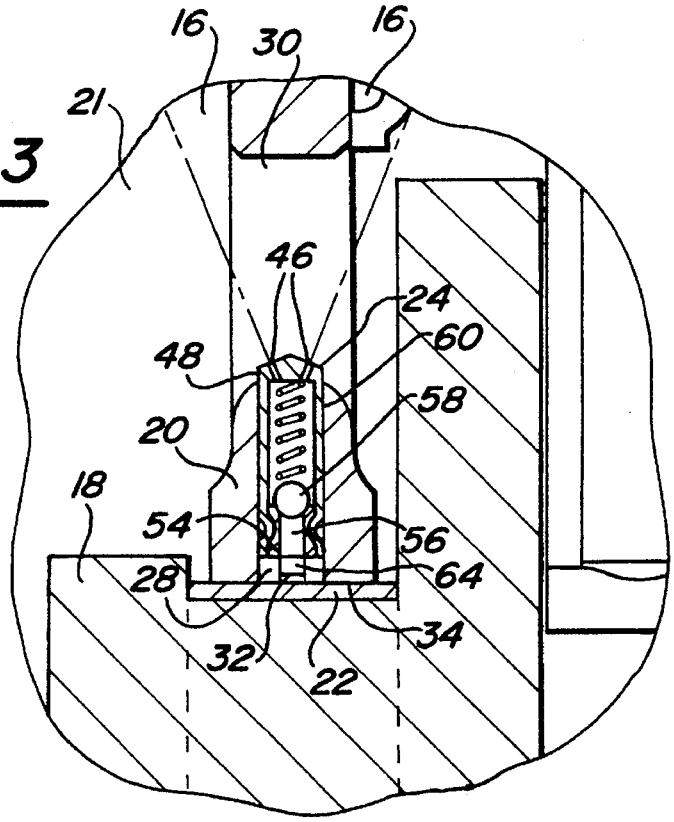
FIG. 3 is a cross-sectional view taken along lines 3–3 shown in FIG. 2.

As shown more clearly in FIGS. 2 and 3, the oil jet nozzle 24 is mounted in a passage 28 drilled into the engine block journal section 20. Passage 28 communicates with a window 30 in the crankshaft cavity 21 at the journal section 20 and an oil groove 32 circumferentially extending about the main bearing seat 34. The bearing sleeve 22 is mounted in the bearing seat 34. The bearing sleeve 22 has an aperture 40 therethrough in alignment with the oil groove 32 for allowing movement of oil to the crankshaft bearing surfaces 38.

The groove 32 is also in communication with an oil port 42 that extends to the main oil gallery 44 which is located through the engine block on the left side of the cylinder 16 as shown in FIG. 2.

Figure 4:
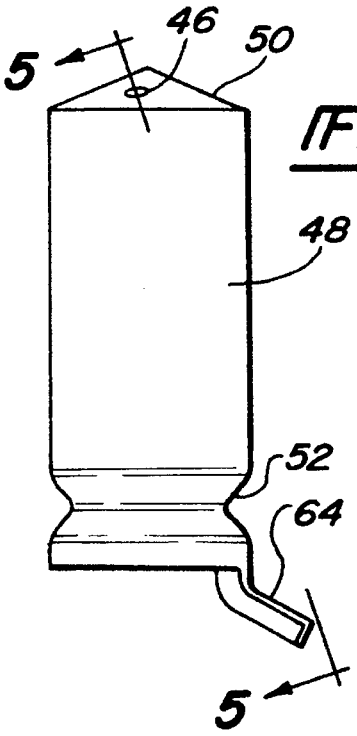
FIG. 4 is a side elevational view of the oil jet nozzle shown in FIGS. 1–3.
Figure 5:
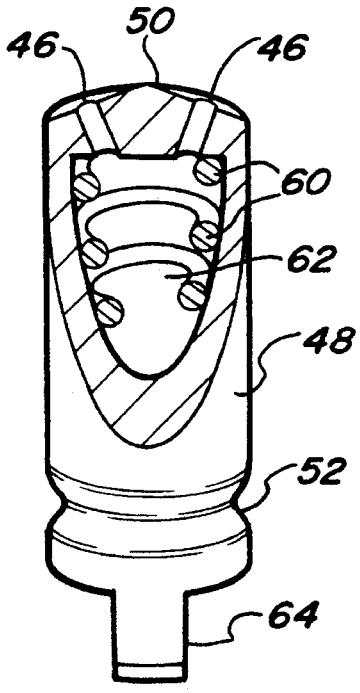
FIG. 5 is a cross-sectional view taken along lines 5—5 shown in FIG. 4.

The oil jet nozzle 24 has two outlets 46 that point generally upwardly in the crankshaft cavity 21 and are pointed into two adjacent cylinders 16. One outlet 46 points to the underside 26 of one piston 14 while the other outlet points toward the underside 26 of an adjacent piston 14. The oil jet nozzle 24 as clearly shown in FIGS. 4 and 5 is made from an extruded body member 48 with the outlets 46 extending through a top end 50. The outlets 46 are angled outwardly as shown in FIG. 5 away from each other. As shown in FIG. 4, the outlets 46 are also angled with respect to the longitudinal axis of the of body 48. The bottom end of the body 48 has a crimped section 52 which retains a lower valve seat member 54. The valve seat member 54 includes an inlet 56 shown in FIG. 6 that is normally closed by a seated ball check valve 58. The ball check valve 58 is normally biased to a closed position by a coil spring 60 mounted in the hollow interior 62 of the extruded body 48. The interior 62 forms a path between the inlet 56 and outlets 46.

The extruded body 48 has an integrally formed tab 64 that extends both downwardly and radially outwardly. The tab 64 has a width that is substantially the same as the width of groove 32 and snugly fits therein such that the tab 64 functions to rotationally affix the jet nozzle 24 in the passage 28.

The groove 32 may also be formed in the bearing sleeve 22 rather than in journal bearing seat 34 as shown in FIG. 7. In this embodiment, the tab 64 is appropriately lengthened to intrude into the groove 32 which is now relatively lower and thereby affixes the nozzle 24 in the same fashion as described above. Alternatively, the housing 48 may be lengthened to accomplish the same effect of locating the tab 64 into the groove 32 in the sleeve 22.

The installation of the nozzle 24 is during assembly of the engine. Before the bearing sleeves 22 and crankshaft 18 are installed, the nozzle 24 is pushed through passage 28 from the groove end till the tab 64 engages the groove 32. The extruded body 48 is press fitted in the passage 28. The tab 64 by extending tightly into the groove 32 also assures that the oil jet nozzle 24 does not work its way loose through the downstream end of passage 28.

During low pressure modes such as engine idle or high torque and low speed situations where all the oil pressure is needed for lubrication, the ball check valve 58 is biased closed by the spring 60 such that no oil flows through the oil jet nozzle 24.

During high pressure modes such as highway cruising speeds, the oil pressure is sufficient to open the check valve 58 to allow oil to flow from oil gallery 44, through passage 42, groove 32, inlet 56, hollow interior 62 and outlets 46. The jet nozzle 24 causes the oil to spray upwardly to hit the underside 26 of pistons 14 along path generally indicated by dashed lines 70.

In the disclosed embodiments, the area 66 of the underside 26 that is sprayed is located laterally on an opposing side of the piston from where the oil gallery 44 is located as clearly shown in FIG. 2 and 6. The spray gets to the other side that is normally obstructed by piston rod 15. The piston rod 15 in this set up is interposed between the spray 66 and the oil gallery 44. This spraying of oil on the other side of the piston 14 and piston rod 15 from the oil gallery 44 is advantageous if the right side the piston 14 as shown in FIGS. 2 and 6 heats up more than the left side. This uneven heating may be due to the shape and contour of the combustion chamber (not shown) that includes the recess 68 in the top surface of the piston 14 or due to the location of the spark plug and any precombustion chamber (not shown).

In this fashion, the oil can be sprayed without obstructions to the side of the piston which has up till now been blocked by the piston rod 15. The hot area of the piston 14 can be reached without drilling or casting any further oil galleries. The present passages 42 and groove 32 are utilized and a jet nozzle is positioned to use the oil pressure and oil flow through the groove 32.

Further in this fashion, an oil jet nozzle is expeditiously manufactured and secured against rotational misalignment to assure that the oil spray is properly directed at all times.

Variations and modifications are possible without departing from the scope and spirit of the present invention as defined by the appended claims.

The embodiments in which an exclusive property or privilege is claimed are defined as follows:

1. An oil jet type piston cooling arrangement for an internal combustion engine having an engine block defining two adjacent cylinders with a reciprocating piston in each cylinder, a crankshaft cavity located beneath the cylinders, a crankshaft with at least one bearing supported in the crankshaft cavity, the engine block forming a journal between the two adjacent cylinders for seating the crankshaft bearing, an oil gallery formed within the engine block for supplying lubricating oil to the journal and bearing, a groove formed in the engine block with at least a portion thereof connected to the crankshaft journal for receiving lubricating oil from the gallery, and a first passage formed in the engine block extending between the two adjacent cylinders substantially parallel to the crankshaft and being located above the crankshaft journal, and a second passage formed in the engine block extending between the groove and the first passage, the oil jet type piston cooling arrangement including a nozzle assembly comprising:

said nozzle assembly having an inlet end portion for receiving oil and an opposite outlet end portion for discharging oil, said nozzle being mounted in the second passage so that its inlet end portion adjacent the groove to receive oil from the journal and so that its outlet end portion opens to the first passage to produce streams of oil for squirting upwardly through the first passage and the cylinders against the underside of each of the adjacent pistons.

2. The oil jet type piston cooling arrangement including a nozzle assembly as defined in claim 1 further characterized by:

said outlet end portion of said nozzle having two outlet ports angled from the nozzle's axis that are directable toward the bottom surfaces of the adjacent two pistons in the engine block.

3. In an internal combustion engine having an engine block housing a reciprocating piston within a piston cylinder, a piston rod operably connecting said piston to a crankshaft, said engine block having a crankshaft cavity under said piston and a crankshaft journal for seating a crankshaft bearing and an oil gallery on one side of said piston cylinder, said oil gallery operably connected to a groove in one of said crankshaft journal and crankshaft bearing for providing passage through said bearing to said crankshaft; said improvement characterized by;

a passage extending from said oil groove to said crankshaft cavity and fitted with an oil jet nozzle for spraying oil onto an underside of said piston;

said oil jet piston cooling nozzle having a body member fitted into said passage extending from said oil groove to said crankshaft cavity;

said nozzle having a downstream section with outlets, an upstream end with an inlet therethrough;

a locating tab portion of said body member adapted to seat in said oil groove;

said tab portion having a width adapted to be snugly received in said oil groove.

4. In an internal combustion engine as defined in claim 3 further characterized by:

a check valve being operably seated in said oil jet nozzle and biased to a closed position;

said check valve being openable upon an oil pressure at said inlet above a predetermined amount to allow passage of oil from said inlet through said body member, to and out of said outlets.

5. In an internal combustion engine as defined in claim 4 further characterized by:

said body of said oil jet nozzle being extruded and said tab being integrally formed with said body.

6. In an internal combustion engine as defined in claim 5 further characterized by:

said extruded body having a crimp that crimps against and retains an inlet and check valve seat member that has said inlet therethrough and has a seat about said inlet for said check valve.

7. In an internal combustion engine as defined in claim 6 further characterized by:

said passage being interposed between two adjacent piston cylinders within said crankshaft cavity with said outlet end of said oil jet nozzle having two angled outlet ports that are aimed at an adjacent two pistons in respective adjacent cylinders of said internal combustion engine.

8. In an internal combustion engine as defined in claim 7 further characterized by:

said nozzle being located on a side of the piston opposite from the oil gallery such that the underside of the piston that is sprayed is above said nozzle on a piston side opposite from the oil gallery.

9. In an internal combustion engine as defined in claim 3 further characterized by:

said nozzle being located on a side of the piston opposite from the oil gallery such that the underside of the piston that is sprayed is above said nozzle on a piston side opposite that from the oil gallery.

* * * * *